United States Patent [19]

Di Nunzio et al.

[11] Patent Number: 5,009,213

[45] Date of Patent: Apr. 23, 1991

[54] STATIC IGNITION DEVICE FOR INTERNAL COMBUSTION ENGINES

[75] Inventors: Vittorio Di Nunzio; Eraldo Giaccardi, both of Turin; Sergio Saluzzo, San Pietro Val, all of Italy

[73] Assignee: Fiat Auto S.p.A., Turin, Italy

[21] Appl. No.: 479,806

[22] Filed: Feb. 13, 1990

[30] Foreign Application Priority Data

Feb. 13, 1989 [IT] Italy ..... 67084 A/89

[51] Int. Cl.[5] ..... F02P 3/04

[52] U.S. Cl. ..... 123/620; 123/606; 123/643

[58] Field of Search ..... 123/606, 607, 620, 622, 123/634, 635, 643

[56] References Cited

U.S. PATENT DOCUMENTS

| | | | |
|---|---|---|---|
| 3,445,723 | 5/1964 | Nilssen | 315/209 T |
| 3,683,881 | 8/1972 | Tutui et al. | 123/620 |
| 4,192,275 | 3/1980 | Weydemuller | 123/607 |
| 4,326,493 | 4/1982 | Merrick | 123/620 X |
| 4,739,185 | 4/1988 | Lee et al. | 123/620 X |
| 4,938,200 | 7/1990 | Iwasaki | 123/620 |

FOREIGN PATENT DOCUMENTS

| | | | |
|---|---|---|---|
| 0026429 | 4/1981 | European Pat. Off. . | |
| 0224452 | 6/1987 | European Pat. Off. . | |
| 2309632 | 9/1974 | Fed. Rep. of Germany | 123/620 |
| 1478043 | 4/1967 | France . | |
| 2611234 | 10/1988 | France . | |
| WO8706979 | 11/1987 | PCT Int'l Appl. . | |

*Primary Examiner*—Willis R. Wolfe

*Attorney, Agent, or Firm*—Sughrue, Mion, Zinn, Macpeak & Seas

[57] ABSTRACT

The device essentially comprises an auxiliary coil for storing the ignition energy, and a transformer for each spark plug. It is thus possible to prepolarize each transformer in the proper sequence with a current opposite that applied during discharge, whereby a transformer of smaller dimensions can be associated with each spark plug while the performance remains unchanged from that of conventional systems.

9 Claims, 5 Drawing Sheets

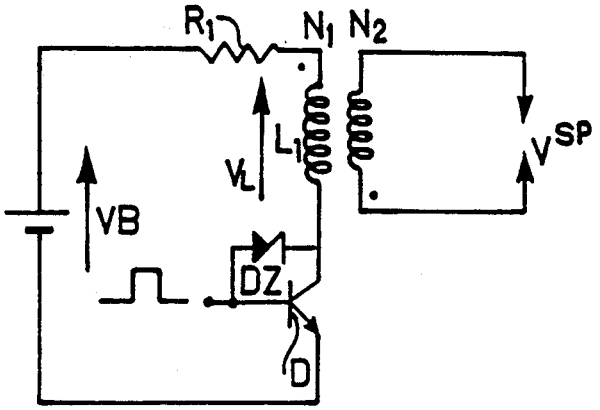
FIG. 1
PRIOR ART
FIG. 3
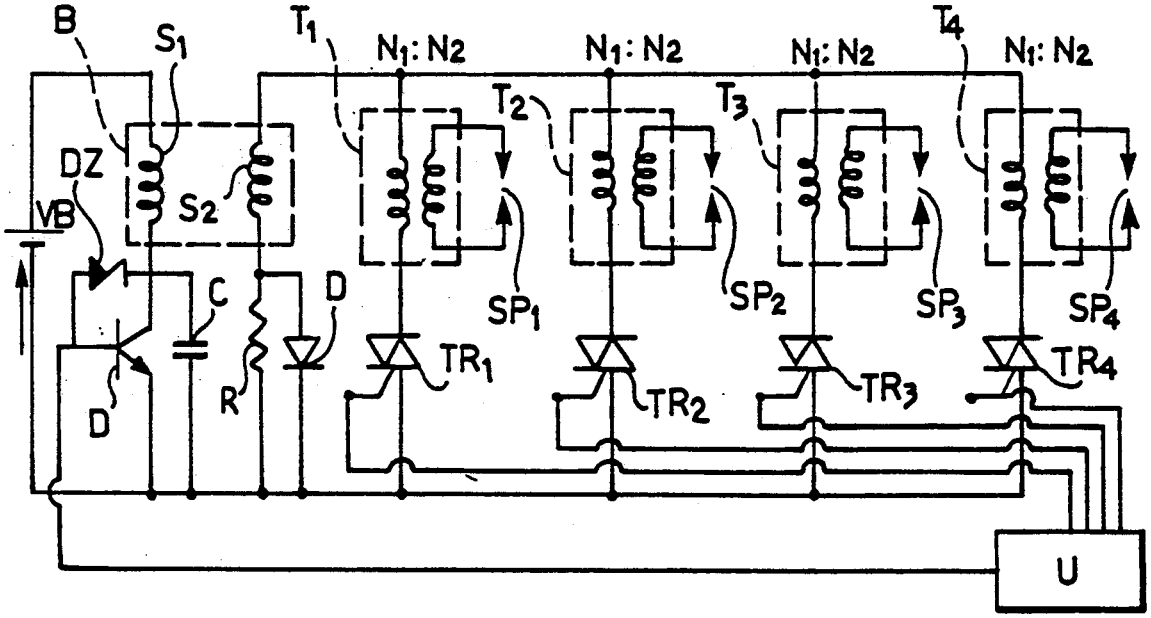
FIG. 5
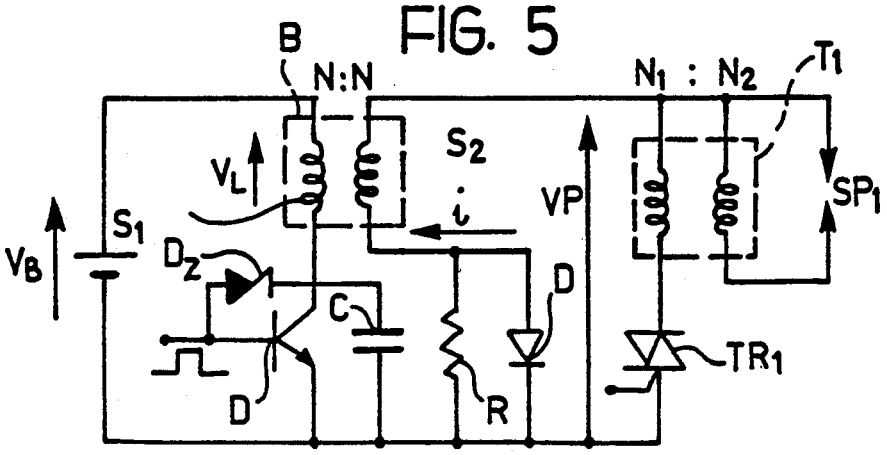

FIG.6a1)
FIG.6a2)
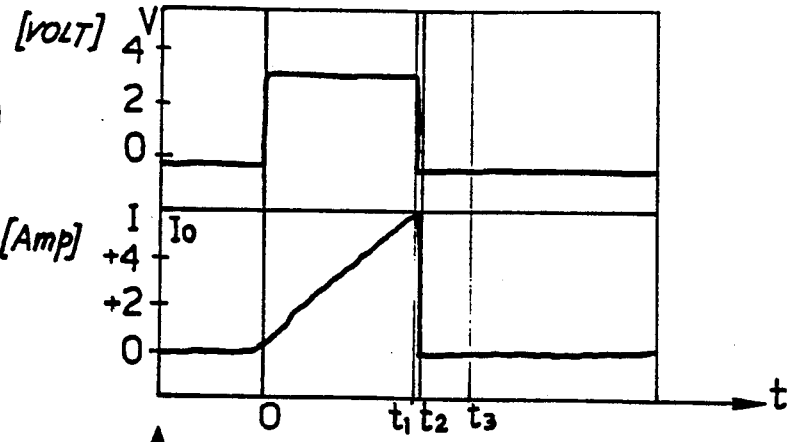
FIG.6b)
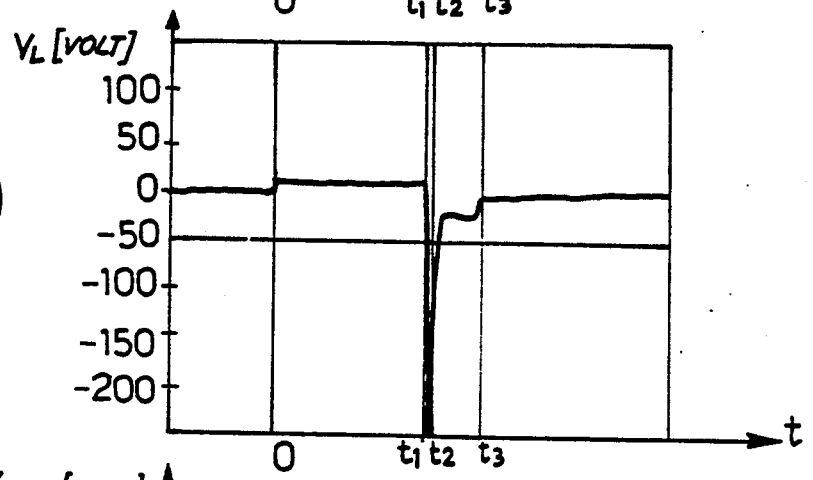
FIG.6c)
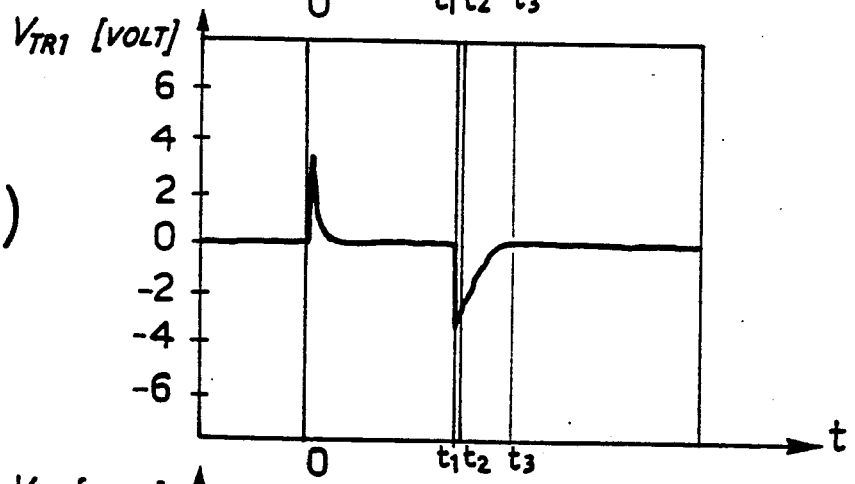
FIG.6d)
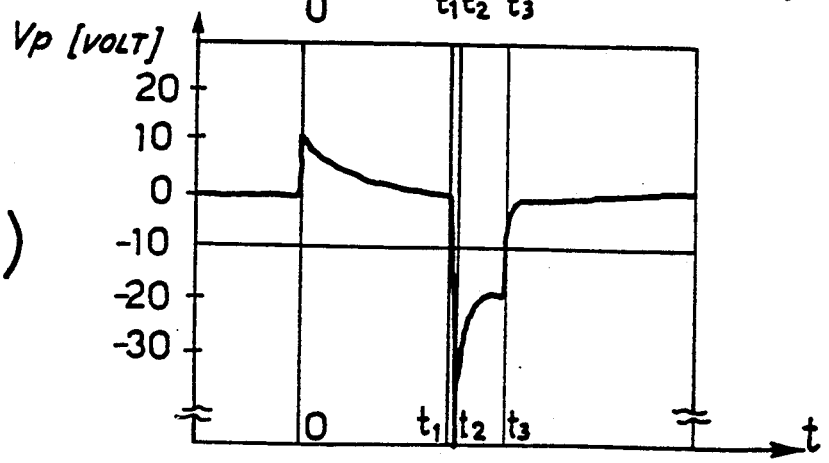

STATIC IGNITION DEVICE FOR INTERNAL COMBUSTION ENGINES

FIELD OF THE INVENTION

The present invention relates to static ignition devices for internal combustion engines.

DESCRIPTION OF THE PRIOR ART

Static ignition systems known today are essentially of two types:

capacitive discharge inductive discharge.

The former store energy at a voltage V in a capacitor C (electrostatic energy $E=\frac{1}{2}CV^2$) which is discharged in the correct sequence to a step-up transformer whose secondary winding is connected to each spark plug; the system generally provides a transformer for each spark plug.

The type of discharge is characterised by:

a very short pre-arc voltage-rise time (of the order of $10^{-6}$ sec);

a very high (300/600 mA) initial peak of the arc (or spark) current, an arc of short duration (a few hundredths of a microsecond).

Whilst the first two characteristics are unanimously recognised as advantages, the duration of the arc, however, may be disadvantageous when it is so short, particularly during operation at low running speeds and with low loads.

For this reason, and because of their cost, these systems are not very widespread.

Inductive discharge systems store energy at a current intensity I in an inductance L (electromagnetic energy $E=\frac{1}{2}LI^2$) which also acts as a step-up transformer. The energy is discharged to each spark plug by the instantaneous cutting-off of the primary current.

There are systems which have a coil for every two cylinders (lost spark), as well as systems which provide a coil for each cylinder; since they are known and used by various manufacturers, reference should be made to the technical literature for a detailed description of their operation.

The type of discharge of these systems is characterised by:

a short pre-arc voltage-rise time (10–20 microseconds);

a small initial arc-current peak (50–100 mA);

an arc of long duration (1–2.5 msec.).

The latter characteristic is very advantageous for the good operation of the engine under all conditions, particularly at low running speeds and with low loads. For this reason, and since they cost less than capacitive systems, inductive discharge systems are the most widespread.

The solutions with a coil for each cylinder mounted directly on the respective spark plug, which is most suitable for engines with odd numbers of cylinders, is the one which has the most obvious advantages, although it is more expensive than the system with a coil for each pair of cylinders.

The advantages are due to the simplification of its mounting on the engine, since there are no very bulky elements, such as insulating caps and high-tension cables, the latter also being sources of radio-frequency interference. However, this system, with a coil for each cylinder, cannot be used on some engines because of the bulk of the individual coils.

OBJECTS AND SUMMARY OF THE INVENTION

Hence, there is a requirement, in an inductive static ignition system for more generalised application, to be able to provide very small coils without a decrease in performance. The object of the present invention is therefore to provide a static ignition device which achieves a reduction in size for a given performance. According to the present invention, this object is achieved by virtue of an ignition device for internal combustion engines, including:

mutual impedance means with a primary winding and a secondary winding with a given ratio of turns, the secondary winding being intended to supply at least one ignition branch circuit having at least one ignition spark plug, excitation means for storing a given ignition energy in the primary winding and for the rhythmic transfer of the energy to the secondary winding, characterised in that:

the given ratio of turns selected is substantially unitary, the at least one ignition branch circuit includes a respective voltage step-up transformer which acts between the secondary winding and the at least one respective ignition spark plug with respective activation means which can selectively cause the transfer of the ignition energy to the voltage step-up transformer in order to carry out an ignition cycle, the arrangement being such that, for each ignition cycle, the induction in the voltage step-up transformer varies between an initial prepolarisation value and a final value, the initial value and the final value being approximately identical in value but opposite in sign.

NOTES ON THE OPERATION OF AN INDUCTIVE IGNITION SYSTEM

In order better to demonstrate the characteristics of the invention, it is convenient to recall some concepts relating to the operation of ignition coils FIG. 1 shows the electrical layout of the circuit generally used; neither the synchronising signals nor the control logic are shown since they are not relevant to the present description.

By way of summary, in FIG. 1, the reference $V_B$ indicates the battery voltage used for charging a mutual inductance or "coil" under the control of an operating unit usually constituted by a Darlington transistor D. $R_1$ indicates the resistance of the primary winding of the coil which has a number $N_1$ of turns and an inductance value $L_1$. The secondary winding of the coil has a number of turns $N_2$. The ignition spark gap (spark plug) is indicated SP and a zener diode $D_z$ for limiting the cut-off over-voltage is associated (in known manner) with the Darlington transistor D. The symbol $V_L$ generally indicates the voltage across the primary winding of the coil.

The operation of the circuit of FIG. 1 can be described as follows, with reference to the time graphs of FIGS. 2*a*–2*e*, which represent:

the trace of the current in the primary winding of the coil (FIG. 2*a*);

the trace of the sparking voltage V (FIG. 2*b*);

the trace of the arc or sparking current (FIG. 2*c*);

the trace of the voltage across the primary winding of the coil (FIG. 2*d*), and the trace of the magnetic flux in the coil and the induction in the iron core FIG. (2*e*).

The circuit is initially at rest until the Darlington transistor D becomes conductive (time 0 in FIG. 2*a*). From that moment, the current in the primary winding increases exponentially until it reaches the maximum value $I_o$ at the time $t_o$.

If, as is assumed, the circuit is a constant-energy circuit, the current is limited to the value $I_o$ until the moment envisaged for the discharge.

During the interval from $t_1$ to $t_2$, a high voltage, up to the dielectric breakdown value, is produced in the secondary winding (the pre-arc voltage FIG. 2*b*) because of the cutting off of the primary current $I_o$.

The discharge, the current of which is shown in FIG. 2*c*, starts from this time ($t_2$) and lasts until the time $t_3$, when the current becomes zero.

From the time $t_3$, the circuit is at rest, awaiting the start of a new cycle (time $t_4=0$).

FIG. 2*d* shows the trace of the electromotive force across the primary winding of the coil. With regard to this, the following considerations are true:

interval from 0 to $t_o$ (ignoring, for simplicity, the voltage drop in the Darlington, the stray capacitance and the impedance of the load before discharge)

$$V_L = L_1 \cdot \frac{dI(t)}{dt} = V_B - R_1 \cdot I(t) \quad (1)$$

where $$I(t) = \frac{V_B}{R_1}(1 - e^{-R_1 \cdot t/L_1})$$

interval from $t_o$ to $t_1$ $$V_L = 0 \text{ since } I(t) = Io = \text{constant and therefore } \frac{dI(t)}{dt} = 0 \quad (2)$$

interval from $t_1$ to $t_2$ $$V_L = V_B - V_Z \quad (3)$$

where $V_Z$= the zener voltage interval from $t_2$ to $t_3$ $$V_L = -\frac{N_1}{N_2}[V_{arc} + R_2 i_2(t)] \quad (4)$$

where $i_2(t)$= the secondary current $R_2$= total resistance affecting the secondary.

Finally, FIG. 2*e* shows the trace of the magnetic flux $\phi$ in the coil and of the induction B in the core ("iron") of the coil. This trace cannot be detected instrumentally but is defined on the basis of the known relationships between electromotive forces and magnetic flux in inductive circuits. In fact, the flux linkage with the coil is related to the voltage applied, according to the equation (with the sign convention indicated in FIG. 1):

$$V_L = N_1 \cdot \frac{d\phi}{dt}$$

where $\phi$= the concatenated flux from which is derived $$\phi = \frac{1}{N_1} \cdot \int_o^t V_L \cdot dt \quad (5)$$

For ease of understanding, it should be noted that, during the interval from 0 to $t_1$, the primary current is purely magnetising, the losses in the iron core being considered negligible, and the flux is therefore proportional thereto.

The induction in the iron core of the coil has a similar trace to the flux, since, as is known, $$\phi = B \cdot S$$

where S is the useful cross-section of the iron core.

If the magnetic dimensioning of the coil is correct, the maximum induction, indicated in FIG. 2*e*, also corresponds to the maximum permitted by the ferromagnetic material used (for normal core plates, $B_{max} \cong 1.1$ Wb/m$^2$).

THE THEORETICAL BASIS OF THE INVENTION

In the prior-art solution described above, the magnetic material operates with induction which can vary only between 0 and $+B_{max}$, whilst in theory it could operate between $-B_{max}$ and $+B_{max}$ (as in transformers).

The ignition device according to the invention is based on the concept of using the coil as a transformer, in which the working induction can vary between $-B_{max}$ and $+B_{max}$.

In fact, since the magnetising current must be limited to acceptable values, it is not possible to use 100% of this range of variation.

For greater clarity, some formulae which enable the preliminary dinensioning of an ignition coil to be carried out are given below.

The equation which links the primary inductance L to the current I flowing therein, to the number of turns N, and to the concatenated flux $\phi$ is:

$$L \times I = N \cdot \phi \quad (6)$$

The inductance L and the maximum current $I_o$ being given, it follows that the coils N, the cross-section S and the maximum induction $B_{max}$ are linked by the equation:

$$N \times B_{max} \times S = L \times I_o \quad (7)$$

When the type of magnetic material to be used is defined, the maximum working induction is also defined.

For example, in the case of normal core plates, where it is assumed that $$B_{max} = 1.1 \ Wb/m^2$$

the equation becomes:

$$N \times S = L \cdot I_o / 1.1 \quad (8)$$

The term N×S, which is to be found, provides the dimensions of the coil, together with other design parameters, such as: the primary resistance, the secondary resistance, the maximum dissipation, the ratio of turns, etc.

Essentially, the present invention is based on the recognition of the fact that, if the core of the coil can be prepolarised to $-B_{max}$, complete use can be made of the magnetic material In fact, by a re-examination of (6), it can be seen that this results from the fact that the voltage across the coil is given by the differential equation:

$$V_L = L \cdot \frac{dI}{dt} \tag{9}$$

or $$V_L = N \cdot \frac{d\phi}{dt} \tag{10}$$

The integration of equation (9) between 0 and $I_o$ and the corresponding integration of equation (10) between 0 and $\phi_{max}$ produces equation (6).

If the iron core is prepolarised to $-B_{max}$ (that is $-\phi_{max}$), the integration of equation (10) leads to the equation $$\int_{-\phi_{max}}^{+\phi_{max}} N d\phi = 2N\phi_{max} = 2N \cdot B_{max} \cdot S \tag{11}$$

which gives:

$$N \times S = \frac{LI_o}{2B_{max}} \tag{12}$$

that is, the dimensioning parameter NxS is exactly halved. This enables, for example, the cross-section of the iron core to be halved for a given number of turns N, or the number of turns N to be halved for a core of a given cross-section, with obvious advantages of size and weight.

The ignition device according to the invention enables complete use to be made of the magnetic core according to equation (12) and thus a considerable reduction in bulk and weight to be achieved.

BRIEF DESCRIPTION OF THE DRAWINGS

An embodiment of the present invention will now be described, purely by way of non-limiting example, with reference to the appended drawings, in which:

FIGS. 1 and 2a–2e relate to the prior art and have already been described above, FIG. 3 shows, in the form of a circuit diagram, the structure of an ignition device according to the invention, FIG. 5 is a version of the diagram of FIG. 3 theoretically simplified for the purposes of illustration, and FIGS. 6a1, 6a2 and 6b–6h are further time graphs which show the traces of signals present in the device according to the invention.

DETAILED DESCRIPTION OF THE INVENTION

The system proposed for a four-cylinder engine is shown schematically in FIG. 3.

As in the case of the conventional circuit of FIG. 1, the reference $V_B$ indicates the battery voltage used for charging the primary winding $S_1$ of a coil B, under the control of a Darlington transistor D with an associated zener diode $D_z$ for limiting the cut-off over-voltage. The coil B is constituted by a mutual impedance which (unlike that in the circuit of FIG. 1) has a primary turns/secondary turns ratio which is unitary or substantially unitary.

The secondary winding $S_2$ of the coil B is connected to the primaries of four voltage step-up transformers $T_1$ to $T_4$ (without air gaps) mounted directly on the ignition spark plugs SP1, SP2, SP3, SP4. The excitation of the transformers $T_1$ to $T_4$ is controlled by respective electronic switches (e.g. triacs) TR1 to TR4, suitably piloted to ensure the correct ignition sequence.

A resistor R is connected in series with the secondary $S_2$ for limiting the current for pre-polarising the transformers T1 to T4 to the value which corresponds to $+B_{max}$. A diode, indicated D, is for short-circuiting the resistor R during the stage when energy is transferred to the spark plugs. A capacitor, indicated C, is connected between the collector and the emitter of the Darlington transistor for limiting the value of dV/dt present in the switches TR1–TR4 at the moment when the Darlington transistor is switched (off).

Finally, a central ignition control unit or similar member is indicated U and controls the excitation of the Darlington transistor D and the triacs TR1–TR4 according to known criteria.

The coil B has the function of storing the electromagnetic excitation energy $E = \frac{1}{2} L I^2$ for each cycle (180° of rotation of the engine)

This energy is then discharged by blocking the conduction of the Darlington transistor D, and, one of the four electronic switches TR1–TR4 having previously been closed, is transferred by the corresponding transformer (T1–T4) to the spark plug at which the discharge is to take place.

Figure 2A:
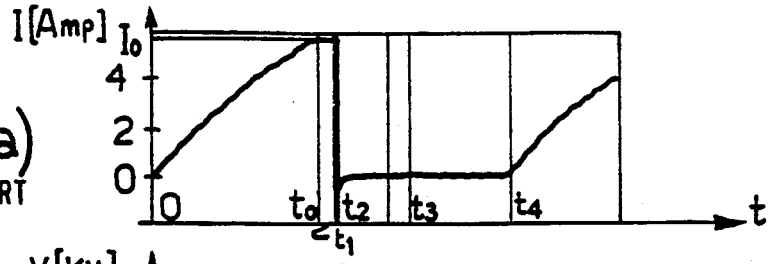
FIG. 2a) PRIOR ART
Figure 2B:
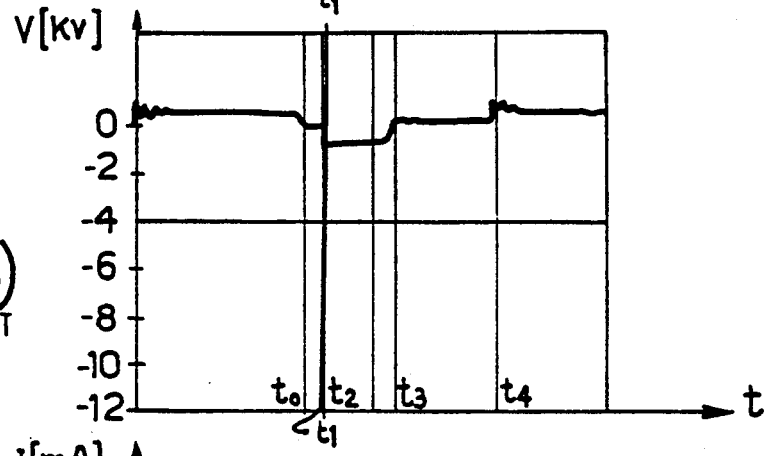
FIG. 2b) PRIOR ART
Figure 2C:
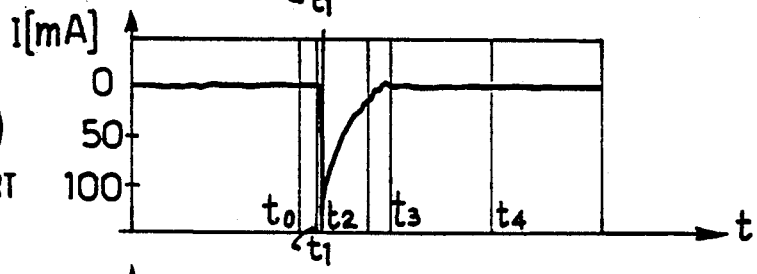
FIG. 2c) PRIOR ART
Figure 2D:
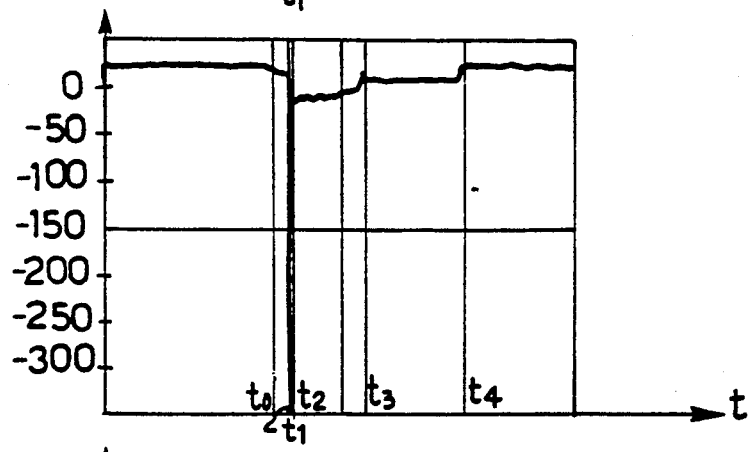
FIG. 2d) PRIOR ART
Figure 2E:
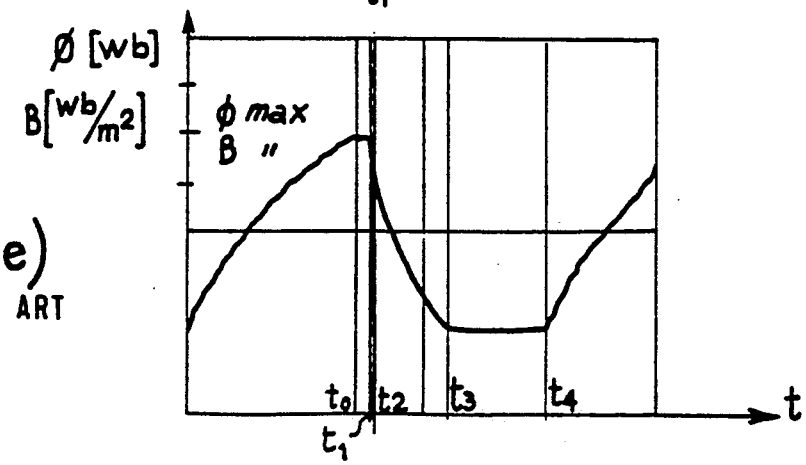
FIG. 2e) PRIOR ART
Figure 4:
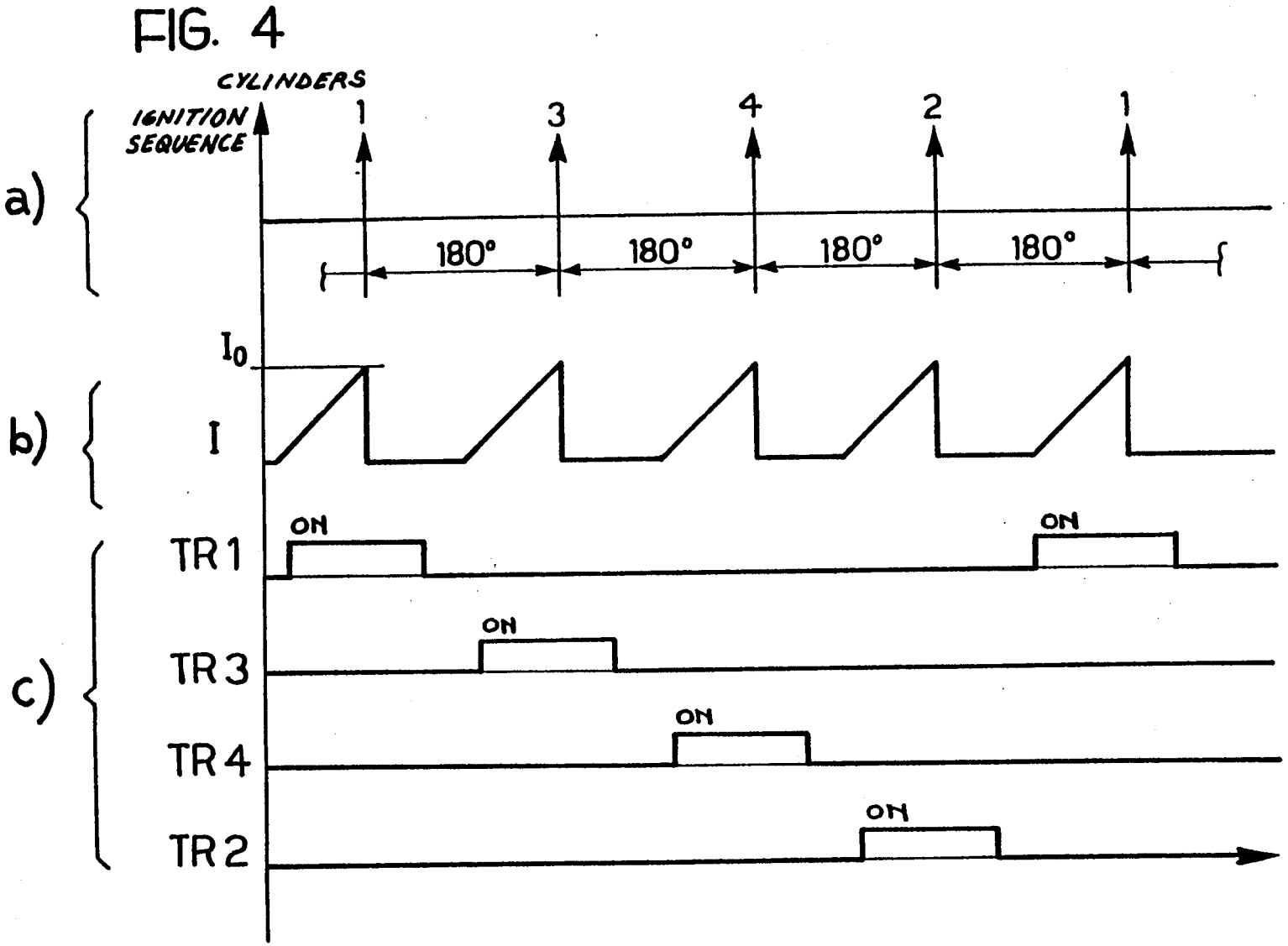
FIGS. 4a–4c show synoptic time graphs which illustrate the operating sequence of the circuit of FIG. 3.

The graph of FIG. 4 show schematically how the central control unit U pilots both the Darlington transistor for charging the auxiliary coil at the current $I_o$ and the sequence of excitation of the triacs TR1–TR4 for transferring the energy stored in B through the transformers T1–T4 to the respective spark plugs SP1–SP4, in dependence on the ignition sequence required by the engine.

In particular, it can be seen that the sequence for the closure (conduction) of each triac TR1 to TR4 is operated in such a way that the respective voltage step-up transformer T1 to T4 is activated only slightly after the time when the Darlington transistor D starts to conduct. The occurrence of spurious peaks in the spark plugs SP1–SP4 during the pre-polarisation stage is thus prevented (or at least reduced).

Such a peak appears in all inductive direct ignition systems which have a coil for each cylinder. It is obvious that this problem can virtually be eliminated by the insertion of a blocking diode in the secondary high-tension circuit (spark plug side). However, this solution is expensive: the solution according to the invention is therefore also advantageous from this point of view.

The characteristic of the circuit of FIG. 3 lies in the fact that, by virtue of the auxiliary coil B, it is possible to prepolarise each transformer T1 to T4 to $+B_{max}$ during the charging stage, as described below.

If one considers the the diagram of FIG. 5, the circuit has been shown with the inclusion of only one voltage step-up transformer T1 and the corresponding piloting triac TR1 for simplicity of explanation.

The description of operation which is given below may also be applied, with a time shift, to the other transformers T2 to T4 when they are enabled by the corresponding triacs TR2 to TR4.

Figure 6:
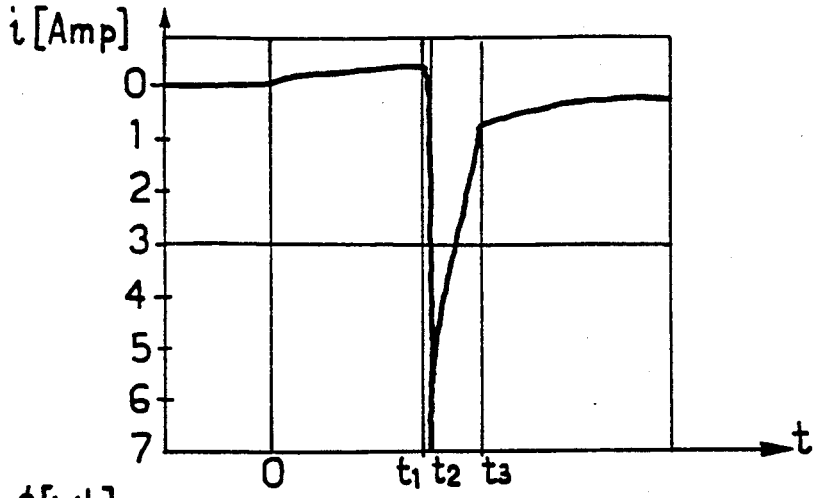
Figure 6:
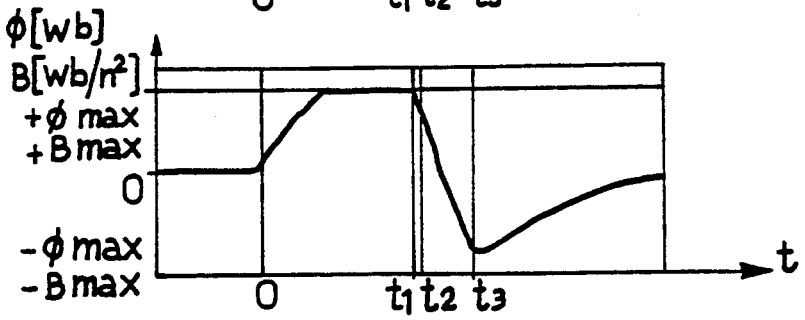
Figure 6:
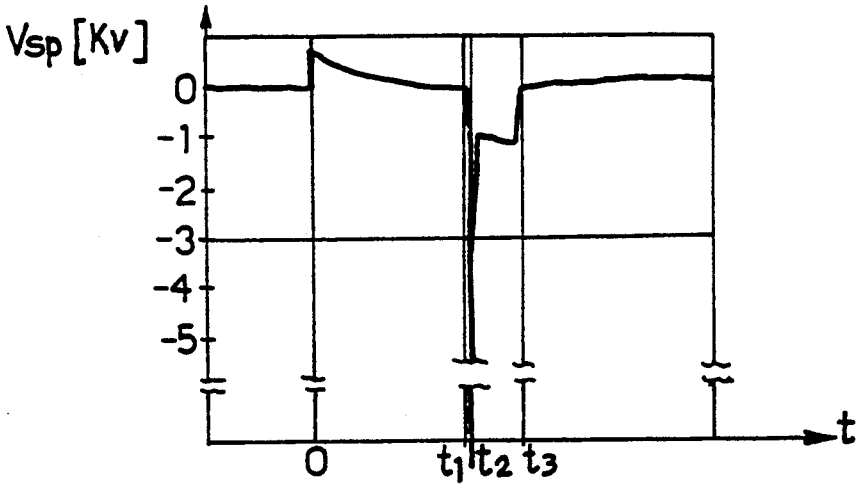
Figure 6:
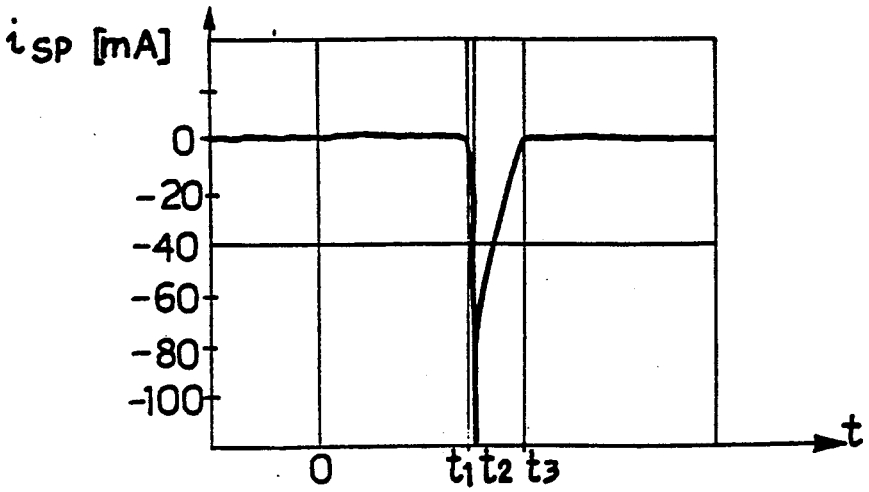

FIGS. 6(*a*1), 6(*a*2) and 6(*b*) respectively show the time traces of the piloting voltage of the Darlington transistor D, the current I in the primary of the auxiliary coil B, and the electromotive force $V_L$.

For an interpretation of these graphs, reference is made, word for word, to that given above with reference to the graphs of FIG. 2. However, it should be noted that, for the particular application described herein, the current in the primary of the coil B cannot be kept at the constant value $I_o$, as in the case first described (the interval $t_o$–$t_1$ of FIG. 2*a*), except to the detriment of the quantity of energy available at the spark plug, as will be explained below.

In order to facilitate understanding of the graphs of FIGS. 6*a*–6*h*, it is stated that $t_1$ is the time at which the Darlington transistor starts to be blocked (which corresponds, at the spark plug, to the start of the rise in the high tension, that is, of the pre-arc stage) and $t_2$ is the time at which the arc is struck (that is, the start of the arc stage).

The closure of the electronic switch TR1 which enables the operation of the transformer $T_1$ takes place slightly after the time 0, and it is switched off when the current i therein falls to a value below the holding threshold ($t > t_3$).

The piloting pulses to the gate electrode (FIG. 6*c*), which are positive after the time 0 and negative at the time $t_1$, serve to ensure that the switch conducts for the required time interval, both with positive current and with negative current.

The voltage $V_p$ which appears across the primary of the transformer $T_1$ (including the triac TR1) has a trace shown in FIG. 6*d*.

With regard to this, the following considerations are true:

interval 0 to $t_1$ $$V_P = V_L - R \cdot i$$

interval $t_1$ to $t_2$ $$V_P \approx V_L$$

interval $t_2$ to $t_3$ $$V_P = -\frac{N_1}{N_2}\left[V_{arc} + R_2 \cdot i_2(t)\right]$$

where $R_2$ = the total resistance affecting the secondary of $T_1$, and $i_2(t)$ = the secondary current of $T_1$.

During the interval 0–$t_1$, therefore, the current i (FIG. 6*e*) will be positive (according to the direction indicated in FIG. 5) and, with a suitably dimensioned circuit, of a sufficient value to prepolarise the iron core of $T_1$ to the induction value $+B_{max}$ (FIG. 6*f*).

If the current I in the primary of the auxiliary coil B were to remain at a constant value $I_o$ for a sufficient time, it would cause $V_L$ to fall to zero with the consequent cancelling out of the prepolarisation current i. This would involve approximately a 30% reduction in the energy available to the spark plug.

The resistance R has the purpose of preventing the prepolarisation current (~300 mA) from rising excessively during the interval 0 to $t_1$, with no advantage, as a result of the saturation of the core of $T_1$. In fact, according to the operating principle of transformers, this current is added to the current I which is flowing in the primary of the auxiliary coil B. An excessive value thereof would cause a useless dissipation of power or, for a given power dissipated, would cause a reduction in the energy stored by the primary of B.

The change of sign of the voltage $V_P$ at the time $t_1$ causes a reversal of the current i which is no longer limited by the resistance R due to the presence of the diode D and can therefore flow freely.

Finally, as regards the trace of the current i (FIG. 6*e*), the following is true:

interval 0 to $t_1$ i= the prepolarisation current of $T_1$+ the current lost in the core;

interval $t_1$ to $t_2$ the reversal of $V_p$ and therefore of i;

interval $t_2$ to $t_3$ i= the arc current attributable to the ratio of turns in the primary of $T_1$+ the magnetising current + the current lost in the iron core. The peak which is noted at the time $t_2$ is caused by the discharge of the capacitor C through the primary of the auxiliary coil B when the arc is struck;

time $t_3$ i+ the magnetising current + the current lost. The arc is extinguished;

$t > t_3$ the residual current decreases slowly and is then rapidly brought to zero at the time when the next triac is switched on.

On the assumption that the amount of energy stored in the primary of the auxiliary transformer B is sufficient, the trace of the flux $\phi$ and therefore of the induction B will be that shown in FIG. 6*f*.

With the use of the circuit of FIG. 4, the transformers are thus made to operate the spark plugs with an inducton which can vary for each ignition cycle between $-B_{max}$ and $+B_{max}$, that is, between an initial prepolarisation value B and a final value. The initial value and the final value, as stated, are approximately equal in value but opposite in sign, so that complete usage of the core is consequently achieved.

It is therefore possible to achieve a reduction of weight and bulk compared with other known systems for a given spark energy and type of core plates.

A further reduction could be achieved with the use of more expensive core plates with a value of $B_{max} = 1.7$ Wb/m$^2$ and very low magnetising currents (such as, for example, tightly packed C-cores without air gaps).

FIGS. 6*g* and 6*h* represent high tension in the spark plug and the arc current respectively.

In comparison with currently known inductive-discharge, static ignition systems, the device according to the invention thus enables:

the storage of the energy necessary for a correct ignition in an auxiliary coil B which, since it has a ratio of turns substantially equal to 1, is smaller and has no problems of insulation between the windings;

its transfer, in the sequence set by the static switches TR1–TR4, to the voltage step-up transformers T1 to T4 which, for this particular use, can be prepolarised so that complete usage is made of the core, with a consequent reduction in bulk and weight;

the elimination of the high-tension cables and the relative protective caps (an advantage similar to systems which provide a coil for each cylinder but which are not practicable in certain cases for reasons of the bulk of the coils, whilst the system proposed herein is practicable by virtue of the smaller size of the transformers).

We claim:

1. In an ignition device for internal combustion engines, including:

mutual impedance means with a primary winding and a secondary winding with a given ratio of turns, the secondary winding being intended to supply at least one ignition branch circuit having at least one ignition spark plug.

excitation means for storing a given ignition energy in the primary winding and for the rhythmic transfer of the energy to the secondary winding, the improvement wherein:

said given ratio of turns is selected substantially unitary, the at least one ignition branch circuit includes a respective voltage step-up transformer which acts between the secondary winding and the at least one respective ignition spark plug with respective activation means which can selectively cause the transfer of the ignition energy to the voltage step-up transformer in order to carry out an ignition cycle, the arrangement being such that, for each ignition cycle, the induction in the voltage step-up transformer varies between an initial prepolarisation value and a final value, the initial value and the final value being approximately identical in value but opposite in sign, and a resistor for limiting the prepolarisation current in the at least one voltage step-up transformer to its initial value is interposed between the secondary winding and the at least one ignition branch circuit.

2. A device according to claim 1, wherein the respective voltage step-up transformer is mounted close to the respective ignition spark plug.

3. A device according to claim 1, wherein the respective voltage step-up transformer has a ferromagnetic core which operates with a reduced magnetising current and low losses.

4. A device according to claim 3, wherein said respective voltage step-up transformer has a core of ferrosilicon plates with oriented grains.

5. A device according to claim 1, wherein the activation means include at least one electronic switch.

6. A device according to claim 5, wherein said at least one electronic switch is a triac.

7. A device according to claim 1, wherein the respective activation means activate the respective voltage step-up transformer slightly after conduction starts in the excitation means, so as to prevent the occurrence of spurious voltage peaks in the ignition spark plugs.

8. A device according to claim 1, wherein the excitation means comprise transistor means, such as a Darlington transistor, whose collector current determines the current which passes through the primary winding, and a capacitor is mounted between the collector and the emitter of the transistor means for limiting the voltage gradient applied to the activation means in use.

9. An ignition device according to claim 1, wherein a short-circuiting diode is associated with the resistor for short-circuiting the resistor during the transfer of the ignition energy to the voltage step-up transformer.

* * * * *